United States Patent [19]

Gaspari et al.

[11] 4,150,369

[45] Apr. 17, 1979

[54] INTRUSION ALARM SYSTEM

[76] Inventors: Russell A. Gaspari, 6656 W. 87th Pl., Los Angeles, Calif. 90045; William H. Dombo, 22343 Pacific Coast Hwy., Malibu, Calif. 90265

[21] Appl. No.: 799,082

[22] Filed: May 20, 1977

Related U.S. Application Data

[63] Continuation-in-part of Ser. No. 734,727, Oct. 22, 1976.

[51] Int. Cl.[2] ..... G08B 29/00; G08B 13/08

[52] U.S. Cl. ..... 340/516; 340/521; 340/545

[58] Field of Search ..... 340/420, 147 MD, 365 S, 340/516, 521, 545

[56] References Cited

U.S. PATENT DOCUMENTS

| | | | |
|---|---|---|---|
| 3,540,043 | 11/1970 | Crosthwait | 340/420 |
| 3,564,139 | 2/1971 | Bodenstein et al. | 340/365 S |
| 3,603,973 | 9/1971 | Hough | 340/420 |
| 3,731,294 | 5/1973 | Vass | 340/420 |
| 3,990,075 | 11/1976 | Schmitz et al. | 340/420 |

*Primary Examiner*—Glen R. Swann, III

*Attorney, Agent, or Firm*—William F. Frank

[57] ABSTRACT

An intrusion alarm system is described which includes multiple-input intruder sensing circuits, the outputs of which are fed via separate logic NAND circuits, to bistable latch circuits which then supply signals to an alarm latch circuit. One of the bistable latch circuits is coupled to the alarm latch via an entry delay timer, and all latches incorporate noise suppression circuitry. The intrusion system has a remote arming and resetting circuit which provides automatic testing of on-board status monitor lamps. This intrusion system is interconnected to an adjust fire/emergency sensing and control unit.

25 Claims, 4 Drawing Figures

INTRUSION ALARM SYSTEM

CROSS REFERENCE TO RELATED APPLICATION

This application is a continuation-in-part of a copending application of Russell A. Gaspari et al. filed on Oct. 22, 1976, under Ser. No. 734,727 entitled "Intrusion Alarm System," now abandoned, the contents of which are incorporated herein in the entirety by reference.

BACKGROUND OF THE INVENTION

This invention relates to an intrusion alarm system for premises. The invention relates more particularly to an electronic intrusion alarm system for use in both residential and industrial premises.

In modern electronic security applications, for both residential and industrial usage, there is a wide choice of alarm systems and intrusion detecting transducers. For example, there exist magnetic switch transducers which detect opening or closing of doors and windows. There are ultrasonic motion detectors, vibration sensors as well as other detecting devices. In all of these types of arrangements, whenever an alarm condition is sensed, a provision is made to provide an alarm, which may take many forms such as an activation of circuitry which automatically telphones a central office, activation of an external alarm bell, activation of special floodlights and the like. All of these known security systems require a control station from which the security system can be armed and monitored.

One such prior art security system is disclosed in the U.S. Pat. No. 3,803,576 to Dobrzanski et al. which discloses a residential alarm system which is provided with at least one normally-open contact switch which is closed by an unauthorized operation of a door or window with which it is associated. The system is designed to monitor only normally-open switch contacts and utilizes an SCR which responds to an output signal produced by the switch contacts to energize an audible alarm. Once the alarm is turned on, it remains on until the system is deactivated. The Dobrzanski et al. alarm system cannot be readily reset because of the fact that SCR's once conducting remain conducting until the anode voltage is removed. Moreover, the Dobrzanski et al. circuit suffers from the shortcoming that it is arranged to operate solely with only one type of intrusion detecting contact switch. The alarm system of Dobrzanski et al. is provided with a two time delays which allow for exit and entry without immediately activating the alarm.

An intrusion alarm system is disclosed in the U.S. Pat. No. 3,787,832 to Bolinger which includes a manually setable mechanical delay device which may be set by an authorized person ready to exit premises sought to be protected so as to allow exit without energizing the alarm system until the mechanical timer arms the system. A similar delay function is provided in the Bolinger alarm system which allows a person to enter the premises without immediately actuating the alarm, a fixed delay between sensing and actuation being provided by a thermal delay device connected in series with the alarm. The system of Bolinger provides as its sensing the sensing of a normally-closed contact switch which, when open, effects the energization of an alarm bell.

The systems disclosed in the two above-mentioned patents, while providing exit and entry delay features, have a number of disadvantages. In particular, each of these known systems is designed to operate with only one type of switch contact. That is, the respective systems are to be associated with either normally-closed contacts or normally-open contacts to the exclusion of the other type. Moreover, neither of these known systems are provided with any instrumentalities which limit the time period during which the alarm is sounded and no reset provisions have been made. Most importantly, the circuit implementations employed in these systems do not allow for the lamp self test, bell timer, and noise suppression features described herein.

SUMMARY OF THE INVENTION

It is an object of the present invention to provide an intrusion alarm system which can be readily associated with either normally-open contact switches or normally-closed contact switches or both types. Furthermore, the circuit design utilized allows this interconnection with a three terminal interconnect which reduces both wiring requirements and interface terminals.

It is another object of the present invention to provide an intrusion alarm system which can be deactivated after sounding an alarm for a predetermined period of time and which can be easily reset, resettability being enhanced by use of NAND logic.

It is a further object of the present invention to provide an intrusion alarm system which can be armed and reset from a remote position. The digital circuitry employed to achieve this goal comprises a dual state counter.

It is an additional object of the present invention to provide an intrusion alarm system which includes logic circuits associated with entry and exit delay control, continuously adjustable and functionally independent as incorporated into the intrusion system.

It is a further object of the present invention to provide an alarm system with monitor and status lamps both of which are automatically tested and reset during the arming sequence.

It is yet another object of the present invention to provide an intrusion alarm system which is substantially free of noise and insensitive to radio frequency interference (rfi). This is achieved by a special diode-capacitor isolator and distributed capactive filtering.

An electronic intrusion alarm system having latch circuit means and an alarm device coupled thereto and responsive to its output, according to one aspect of the present invention, is provided with a passive voltage divider having as parts thereof both normally-closed and normally-open contact switches. In the event only one type of these contact switches is to be associated with a door, window or the like, the other can simply be wired into the circuit as a fixed circuit element.

An electronic intrusion alarm system having latch circuit means and an alarm device coupled thereto and responsive to its output, according to a further aspect of the present invention, includes circuit which provides both an arming signal and a reset signal for placing the system into operation.

An electronic intrusion alarm system having latch circuit means and an alarm device coupled thereto and responsive to its output, according to another aspect of the present invention, includes between a power supply and the alarm and control circuitry, a noise suppression interface circuit.

The alarm system of the present invention includes logic elements which effect novel implementation of the protection of the premises. A built-in remote arming circuit is implemented such that a momentary closing of push-botton remote switch advances a digital counter to sequence the condition status between off and on and reset. Use of the push-button type interface allows multiple remote stations to sequence the condition independently.

To interface the sensing transducers, logic and conductive circuit elements are provided so that the circuit can be associated equally well with normally-open contact switches, normally-closed switches, and, in fact, mixtures of such types.

Exit delay is implemented in the present invention by using a RC timing circuit connected to respective NAND circuits from a source of arming voltage, the NAND circuits having second inputs from respective intrusion sensing circuits. This technique provides stable noise immune status recall without the need for silicon-controlled rectifiers. A resettable deactuation timer is provided which turns off the alarm after a set time period has elapsed. The NAND latch technique also allows a very simple retrigger circuit which gives the user an important capability of reactivating the protect loop after the deactivation timer has timed out and turned off the alarm bell or the like.

The automatic status lamp test is interconnected such that the momentary contact actuation switch also activates the status lamps, but releases lamp control when the momentary contact is released. This same auto lamp test feature is provided in the "local" or non-remote arming activation by activating the lamps at turn-on followed by a manual lamp reset. By interconnecting a finite minimum exit delay in the delay circuitry, this lamp test feature will not inadvertently trigger the alarm latch.

DETAILED DESCRIPTION OF THE PREFERRED EMBODIMENT

Figure 1:
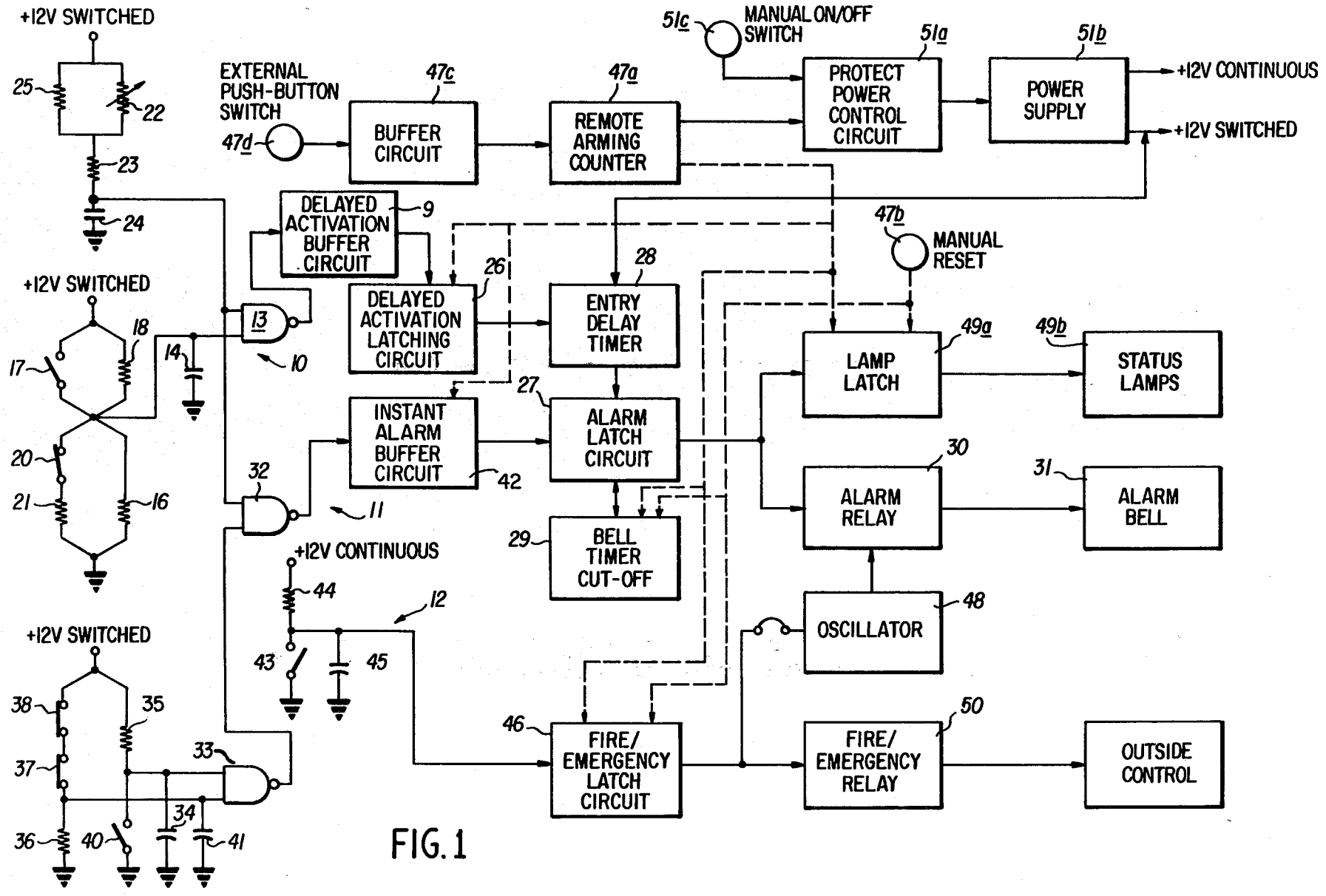
FIG. 1 is a schematic of an embodiment of an alarm system, partially in block diagram form, according to the present invention.

Referring now to FIG. 1, an illustrative embodiment of an intrusion alarm circuit according to the present invention includes a first intrusion sensing circuit 10, a second intrusion sensing circuit 11, and a fire/emergency sensing circuit 12.

The intrusion sensing circuit 10 includes a NAND circuit 13 having two inputs and a single output. The first input of the NAND circuit 13 is connected to an impedance status sensing circuit comprising a noise suppression capacitor 14 and a voltage dividing circuit composed of a resistor 16 connected to a +12 volt switched terminal, to which the arming voltage is applied, via a normally-open contact switch 17. Connected in parallel with the normally-open contact switch 17 is a resistor 18. A normally-closed contact switch 20 is connected across the resistor 16 via a resistor 21. The 12 volt switched terminal receives its voltage from a regulated power supply or battery, via an arming circuit.

The second input of the NAND circuit 13 is connected to a RC timer circuit formed by a variable resistor 22, a fixed resistor 23, and a capacitor 24 connected in series in the order named between a +12 volt switched terminal, to which the arming voltage is supplied, and ground. A fixed resistor 25 is connected in parallel with the variable resistor 22. The voltage across the capacitor 24 provides the enabling signal to the NAND circuit 13. The variable resistor 22 is adjusted by a user to provide a desired exit time delay so that a user can arm the circuit and leave the premises before the capacitor 24 becomes charged to the NAND gate high logic level.

The output of the NAND circuit 13 is connected, via a delayed activation buffer circuit 9, to a delayed activation latching circuit 26 which is coupled to a bistable alarm latch circuit 27, via an entry delay circuit 28. A bell timer 29 is coupled to the alarm latch circuit 27 for resetting it upon the expiration of a given time period, for example, after a four minute period. The output of the bistable alarm latch circuit 27 is coupled to an alarm relay 30 which, in turn, is coupled to an external alarm bell 31. The output of the alarm latch circuit 27 is also connected to an input of a lamp latch circuit **49*a* which has its output connected to at least one status lamp 49*b*. It is to be appreciated, of course, that the alarm latch circuit 27** may additionally or alternatively supply an output signal for actuating automatic telephone dialing equipment to or the like to alert a watchman at a remote location.

The intrusion sensing circuit 11 includes a NAND circuit 32 having an output and two inputs. The first input of the NAND circuit 32 is connected to the junction between the capacitor 24 and the resistor 23 so that the NAND circuit 32 receives as its first input the same enabling signal as the NAND circuit 13. The second input to the NAND circuit 32 is provided from a NAND circuit 33 having one of its normally high inputs connected through a resistor 35 to a +12 volt switched terminal and through a normally open switch 40 to ground such that the closing of this normally open switch 40 will invert the state of the NAND circuit 33, and having the other of its normally high inputs connected through a resistor 36 to ground and through normally closed switches 37,38 to the +12v switched terminal such that the opening of either normally closed switches 37,38 will also invert the state of the NAND circuit 33. Noise suppression capacitors 34,41 are provided for each of the inputs of the NAND circuit 33. It is to be understood that one of the normally closed switches, 37 and 38, represents a series chain of switches in the external protected area, while the other normally closed switch represents a tamper switch within the control panel enclosure.

The output of the NAND circuit 32 is coupled to an instant alarm buffer circuit 42 which has its output directly fed to the bistable alarm latch circuit 27. In operation, the buffer circuit 42 is arranged to effect actuation of the bistable alarm latch circuit 27 without any delay and, like the buffer circuit 9, may be a simple RC differentiating circuit. Thus, all normally-open and normally-closed contact switches associated with the buffer circuit 42 are those which a user wishes to select for instant alarm signaling. This is distinct from the latching circuit 26 which, because of the delay timer 28, does not effect the sounding of an alarm until a given delay between entry of the premises sought to be protected. Thus, the normally-open contact switch 17 and/or the normally-closed contact switch 20 of the sensing circuit 10 are selected by the user to be those associated with a door or the like through which entry of authorized persons to the vacant premises is to be effected. This allows authorized persons to enter the premises protected by the circuit 10 and to disarm the system before the alarm is sounded.

The fire/emergency sensing circuit 12 includes a normally-open contact switch 43 connected to a +12 volt continuous terminal via a resistor 44, a capacitor 45 being connected in parallel with the normally-open contact switch 43. This sensing switch is connected to the input of a bistable latch circuit 46. The second input of the latch circuit 46, as well as a second input of the lamp latch circuit 49*a* is coupled to a source of reset voltage, shown as a remote arming counter 47*a*. A manual reset 47*b* is coupled to third inputs to the latch circuit 46 and the lamp latch 49*a*. The counter 47*a*, its associated buffer 47*c* and external push-button switch 47*d* are shown in detail in FIG. 2. It is to be understood that if no remote arming and reset features are desired, the arming and reset functions could be accomplished by the manual reset 47*b* using relatively simple switches which could be operated by a user on the premises and could be placed in the control box. The output of the fire/emergency bistable latch circuit 46 is connected to the enabling input of a free running oscillator 48, which may be a multivibrator. The oscillator 48 has its output connected to the alarm relay 30 so that it can intermittently enable the alarm relay 30; as a result, the alarm bell 31 rings intermittently in the event the switch 43 is closed in response to an emergency condition, such as a fire. By this technique, a user can distinguish between and an intrusion actuation of the alarm bell, which causes the bell to ring continuously, the actuation by a fire or other emergency condition. As illustrated, the output of the fire/emergency latch circuit 46 is also provided to a special fire/emergency relay 50 which can effect the dialing of a telephone number of an emergency service such as a neighborhood fire station.

Figure 2:
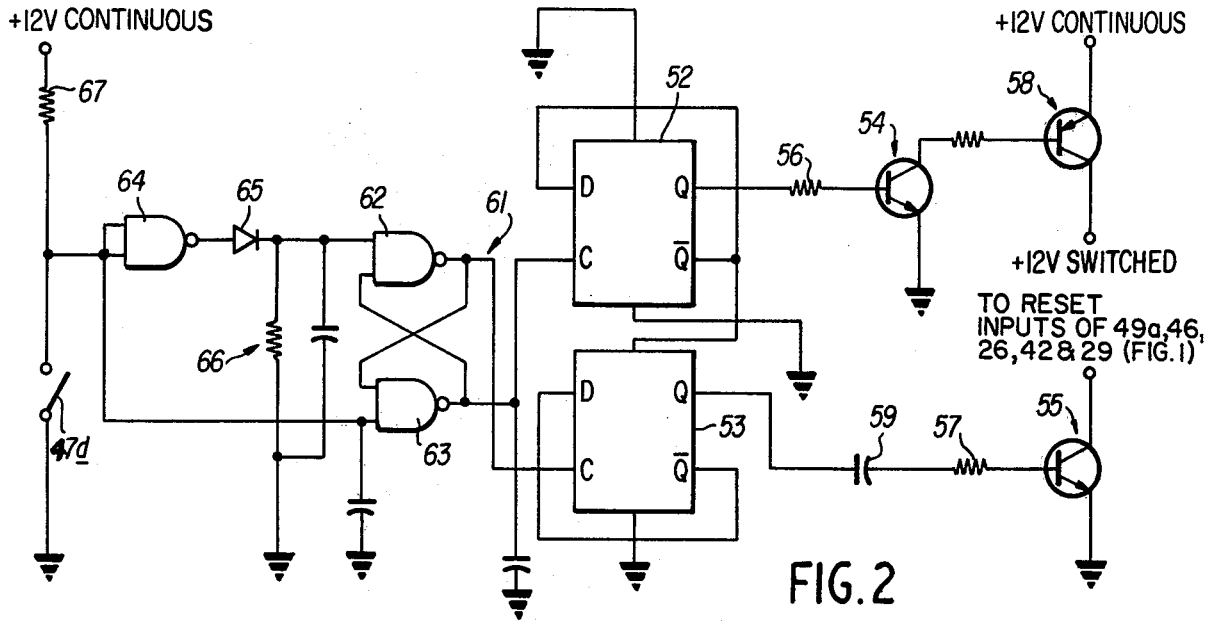
FIG. 2 is a schematic diagram of a remote arming and reset circuit which may be used in the circuit of FIG. 1.

As shown in FIG. 1, the system of the present invention includes the remote arming counter 47*a*, which is shown in more detail in FIG. 2. The remote arming counter 47*a* is provided with a reset output and an arming output. Engerization of the remote arming and reset counter results in a reset signal being produced which is supplied to the delayed activation latching circuit 26, the instant alarm buffer circuit 42, the fire/emergency latch circuit 46 and to the bell timer 29 to reset these circuits to their initial condition. A second output from the remote arming counter 47*a* is supplied to a switch means in a power supply so as to provide the 12 volt switched potential to the terminals illustrated as receiving this voltage and to the entry delay timer 28, this voltage being the arming voltage.

In order to place the intrusion alarm system of FIG. 1 in operation, the power supply 51*b* is energized and the remote arming counter 47*a* activated from an external push-button switch 47*d* via a buffer circuit 47*c*. The counter 47*a* provides from one output, via a control circuit 51*a*, an arming signal pulse to a switching device in a regulated power supply 51*b* which energizes the various +12 volt switched terminals and also the entry delay timer 28. The counter 47*a* also provides at another output a reset signal pulse which resets bistable latch circuits 46 and 49*a*, as well as circuits 26 and 42, to initial states. The remote arming counter 47*a* is controlled from the external switch 47*d*, via a buffer circuit 47*c*.

As shown in FIG. 2, the remote arming counter 47*a* (FIG. 1) is formed by two interconnected, flip-flops 52 and 53 arranged as a conventional two state counter, the respective Q outputs from the circuits 52 and 53 being fed to the bases of respective transistors 54 and 55 via resistors 56 and 57, respectively, the resistor 57 being connected in series with a capacitor 59.

The transistor 54 has its collector connected to the base of transistor 58 which, when made conductive, supplies the 12 volt power to the 12 volt switched terminals and to the entry delay circuit 28 of FIG. 1. The Q output of circuit 53 is supplied to the base of the transistor 55 via the series connected capacitor 59 and resistor 57. As a result any time the state of the circuit 53 changes to positive to provide a Q output, a pulse is delivered to the base of the transistor 55 causing it to conduct. This places a momentary ground on the reset inputs of the latch 49*a* and 46 and the bell timer 29 the ground not being shown in FIG. 1. As a result, these circuits are reset. The input to the counter composed of the two interconnected flip-flops 52 and 53 is effected by a single depression of a remote arming push-button switch 47*d* which causes a trigger circuit composed of two interconnected two-input NAND circuits 62 and 63 to supply debounced, opposite polarity pulses to the respective flip-flops 52 and 53 of the counter. Respective free input terminals of the NAND circuits 62 and 63 are connected to the remote arming switch 47*d*, directly in the case of the NAND circuit 63 and indirectly via an inverter 64, a diode 65 and a resistor-capacitor circuit 66 in the case of the NAND circuit 62. As shown, the input of the inverter 64 is connected to a 12 volt continuous terminal via a resistor 67.

The sequence of operation is set out below. In the event either the normally-closed or normally-open contact switches 20 or 17 are changed to their opposing state, provided the capacitor 24 has been charged above logic high level, the bistable delayed activation latching circuit 26 switches to its other state and, after a delay provided by the entry delay circuit 28, causes the bistable alarm latch circuit 27 to be placed in its second state. The alarm latch circuit 27 causes the alarm relay 30 to energize the alarm bell 31. At the same time, the alarm latch circuit 27 causes the bell timer 29 to start, the bell timer 29 providing an output to the alarm latch 27 after the expiration of a given time period, for example, four minutes. The output from the bell timer 29 resets the alarm latch circuit 27 to its original state where it remains until it receives a further signal from either the buffer circuit 42 or the latching circuit 26.

In the event either the normally-open contact switch 40 or the normally-closed contact switch 37 or the normally-closed contacts 38 are changed to the opposite state, as a result of someone tampering with the control box or entering the premises, the bistable instant alarm buffer circuit 42, provided an enabling signal has been supplied to the NAND circuit 32 from the capacitor 24, is placed in its second state causing the alarm latch circuit 27 to assume its second state. As a result, the alarm relay 30 is energized causing the bell 31 to ring continuously until the bell timer 29 resets the alarm latch circuit 27. In each instance, the lamp latch circuit 49*a* is set in one of its stable states and energizes its associated lamp 49b so that at a time subsequent to the return of circuit 27 to its initial state, it can be known that the alarm 30 has sounded.

Were the normally-open contact switch 43 to close because of a fire or other emergency, the oscillator 48 would become energized and intermittently energize the alarm relay 30, causing the bell 31 to ring intermittently until the latch circuit 46 is reset by the remote arming and reset counter 47 or, if the remote arming feature is not provided, by a master reset switch located on the premises.

Figure 3:
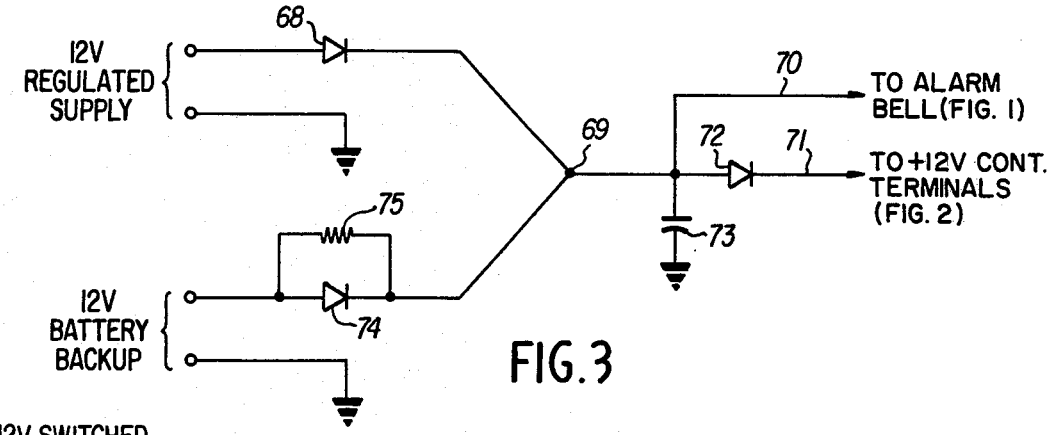
FIG. 3 is a schematic diagram of a noise suppression interface circuit which can be used to supply the operating voltage for the circuit of FIG. 1.

In order to minimize noise sensitivity in the system shown in FIG. 1, especially disturbances which can be transmitted undesirably via power supply lines, the noise suppression interface circuit of FIG. 3 can be provided between the 12 volt regulated supply and the 12 volt supply line to bell and other external circuitry, on the one hand, and the 12 volt continuous supply line to the control box, on the other hand. As shown in FIG. 3, the noise suppression interface circuit includes a protection diode 68 connected from the positive side of the 12 volt regulated supply to a point 69, this point being connected directly to the 12 volt bell and external circuitry via line 70 and to the 12 volt control panel circuitry via line 71 and a diode 72. A capacitor 73 is connected between the point 69 and ground. A third diode 74 is connected between the positive side of a 12 volt battery backup voltage source and the point 69 for battery polarity protection. A resistor 75 is connected across the diode 74 to provide battery charging current limitation.

Built-in-test features are incorporated into the circuitry such that during the arming sequence, whether local or remote, the emergization of power onto the protect circuitry causes the alarm latch circuit 27 to simulate an 'alarm' condition by the use of time delay control circuitry onto the respective latch inputs. This in turn causes the lamp latch 49a to set up in a 'set' condition which activates the status lamps 49b through lamp driver buffers. Reset of the lamp latch 49a, either manually or be release of the external push-button, resets the latches and completes the circuit test.

As herein above-described, the instusion alarm system of the present invention can be considered to protect a given area. It is to be appreciated that a variant of the system can be used to protect a plurality of zones, as shown for purposes of illustration of FIG. 4.

Figure 4:
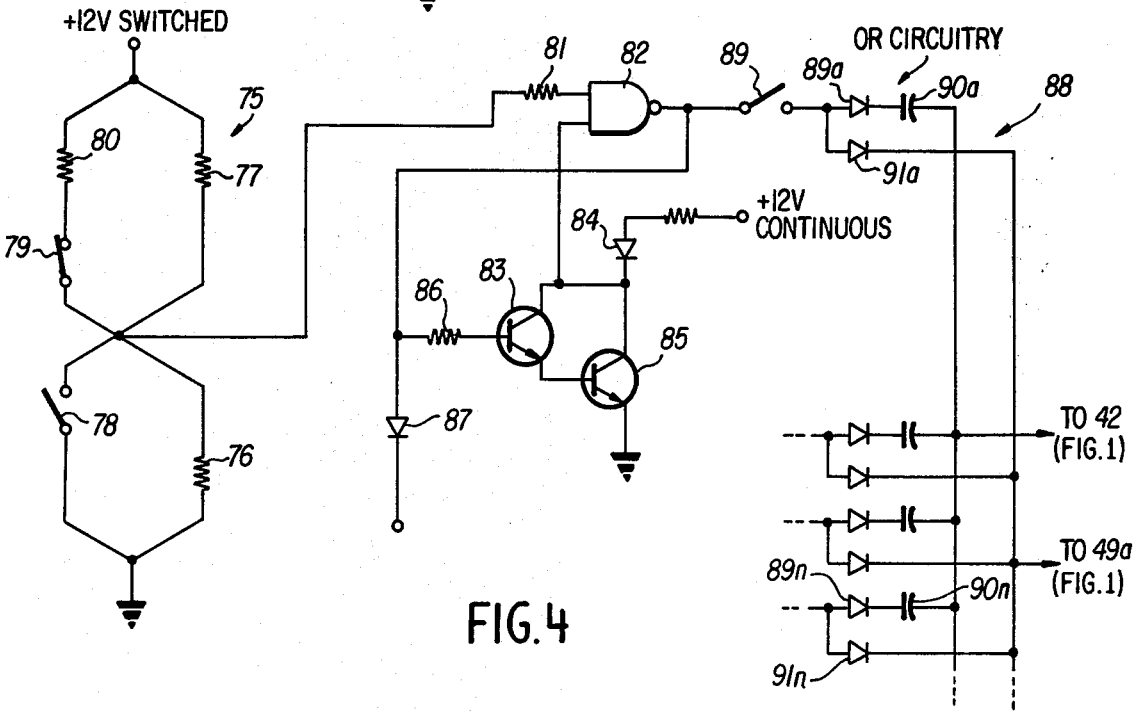
FIG. 4 is a schematic diagram of a circuit which allows the circuit of FIG. 1 to be interfaced with a zone control subnetwork.

In FIG. 4, a first zone is protected by an intrusion sensing circuit generally denominated by the numeral 75 which includes resistor 76 and 77 connected between a +12 volt switched terminal and ground. A normally open switch 78 is connected across the resistor 76 and in series with a normally closed switch 79 and a resistor 80 between ground and the + volt switched terminal. The switch 79 and the resistor 80 being connected in parallel with the resistor 77. The junction between the resistor 76 and 77 is connected, via a resistor 81, to a first input of an NAND circuit 82. The second input to the NAND circuit 82 is connected to the collector of a transistor 83 which is connected to a +12 volt continuous terminal via light-emitting diode 84, this diode being connected to ground as well via the collector-emitter path of transistor 85 which has its base connected to the emitter of the transistor 83. The base of the transistor 83 is connected to a source of reset voltage via a resistor 86 and a diode 87; the reset voltage could be provided, for example, from the manual reset 47b (FIG. 1) or the remote arming counter 47a (FIG. 1).

The output of the NAND circuit 82 is coupled to the base of the transistor 83 via the resistor 86, and to OR circuitry 88 via a switch 89 which can be used to select which individual zones are to be protected.

The OR circuitry includes, for each respective zone, a respective first diode 89a . . . 89n connected in series with a respective first capacitor 90a . . . 90n, each capacitor 90a–90n having one plate in common with those of the others and being connected to the input of the instant activation latch circuit 42 (FIG. 1).

The OR circuitry includes additionally a respective second diode 91a . . . 91n connected with one pole thereof to a common point which, in turn, is connected to the lamp latch 49a (FIG. 1).

In the event the latching circuit 26 is a bistable circuit, it could be atuomatically reset by the same output from the bell timer cut off 29 which resets the alarm latch circuit 27. It is to be understood that the instant activation latch circuit 42 can be replaced by a non-latching control circuit if desired in many installations. If desired, an additional output from the delayed activation buffer circuit 9 could be fed to a warning circuit which produces a distinct signal, such as an audible tone or the like, to warn persons entering the premises that the alarm bell 31 will ring unless the circuit is disarmed within a set period from the onset of the distinct signal. Each of the latch circuits can be provided outputs which energize light emitting diodes or the like, as indications of individual circuit conditions. Test loops can be provided for checking circuit functions.

It is to be understood that the foregoing description of illustrative embodiments of the present invention have been given by way of example, not by way of limitation. Numerous variants and other embodiments are possible without departing from the spirit and scope of the invention, its scope being defined by the appended claims.

What is claimed is:

1. An electronic intrusion alarm system comprising:

at least one intrusion sensing circuit including first loop means with at least one normally-open contact switch and second loop means with at least one normally-closed contact switch, said sensing circuit including control signal circuit means responsive to output from said loops for producing a control signal whenever any of said contact switches is placed in its opposite condition;

latch circuit means responsive to the control signal output of said control signal circuit means for producing an enabling signal;

alarm signal producing means responsive to the enabling signal from said latch circuit means for producing an alarm signal, wherein said first loop means includes a first resistance means in series with said normally-open switch means across a voltage source, and said second loop means includes a second resistance means in series with said normally-closed contact switch means across said voltage source, at least a part of said first resistance means being in parallel with said normally-closed contact switch and at least a part of said second resistance means being in parallel with said normally-open contact switch means, a common point of each of said loops being connected to an input of said control signal circuit means; and manual reset and arming means for resetting said latch circuit means.

2. An alarm system according to claim 1, wherein said control circuit means comprises a logic circuit element having a first input connected to said common point and a second input coupled to a source of enabling voltage.

3. An alarm system according to claim 2, wherein said source of enabling voltage includes circuit means for providing exit delay.

4. An alarm system according to claim 3, wherein said logic circuit element is a NAND circuit.

5. An alarm system according to claim 1, wherein said control signal circuit means comprises a logic circuit element having a first input coupled to a point on said first loop means and a second input coupled to a point on said second loop means.

6. An alarm system according to claim 5, wherein said logic circuit element is a NAND circuit.

7. An alarm system according to claim 5, wherein said control signal circuit means includes a second logic circuit element having its first input coupled to the first-said logic circuit element and responsive to its output, a second input of said second logic circuit element being coupled to a source of enabling voltage.

8. An alarm system according to claim 7, wherein said source of enabling voltage includes circuit means for providing exit delay.

9. An alarm system according to claim 7, wherein the first-said logic circuit element is a first NAND circuit and said second circuit element is a second NAND circuit.

10. An alarm system according to claim 1, further including a condition sensing circuit responsive to a condition of premises to be protected for generating an output signal in response to an abnormal condition, and circuit means responsive to output from said condition sensing circuit for enabling said alarm signal means upon occurrence of the abnormal condition.

11. An alarm system according to claim 10, wherein said condition sensing circuit is responsive to changes caused by fire.

12. An alarm system according to claim 1, wherein said manual reset and arming means is at a remote location.

13. An alarm system according to claim 12, wherein said reset and arming means interconnects to a two state counter circuit, said counter circuit having a first and a second stage and being controlled by a push-button switch whose buffered outputs are connected to an input to said first stage of the counter and coupled to an input to said second stage of the counter via an inverter, a diode, a RC circuit and a pair of interconnected NAND circuits connected in cascade.

14. An alarm system according to claim 1, including a power supply means for providing operating voltages to control panel circuitry including said latch circuit means and to external circuitry including said alarm signal producing means, a further power supply means comprising a regulated power supply, and a noise suppression interface circuit means connected between said regulated voltage supply and said panel circuitry and said external circuitry, said interface circuit means including a first diode connected from said regulated voltage supply to a given point, said point being directly connected to said external circuitry, to a point of reference potential via a capacitor and to said control panel circuitry via a second diode.

15. An alarm system according to claim 14, wherein said interface circuit means further includes a second diode shunted by a resistor connected between said point and a terminal of a backup battery.

16. An alarm system according to claim 1, which incorporates a reset and arming circuit comprising a two state counter circuit having a clock input, said counter circuit being controlled by a push-button switch buffered by a de-bounce circuit and connected to the clock input of said counter circuit.

17. An alarm system according to claim 16, which incorporates means to allow provision for automatic test during the turn-on arming sequence.

18. An alarm system according to claim 1, which incorporates a power supply arrangement comprising power supply means for providing operating voltages to at least first circuitry and second circuitry, a further power supply arrangement comprising a regulated voltage supply, and a noise suppression interface circuit means connected between said regulated voltage supply and said first circuitry and said second circuitry, said interface circuit means including a protection diode connected from said regulated voltage supply to a given point, said point being directly connected to said first circuitry, to a point of reference potential via a high storage capacitor and to said second circuitry via a clipping diode and a second smaller capacitor with fast reaction time.

19. An alarm system according to claim 18, wherein said interface circuit means further includes a battery backup interconnect circuit comprising a separate protection diode and a current-limiting resistor which allows charging of a backup battery from the main power source up to the open circuit voltage of the battery.

20. An alarm system with battery backup circuitry as in claim 19, wherein the battery charging capability can be disconnected by the cutting of a single jumper.

21. An alarm system according to claim 1, including a plurality of said intrusion sensing circuits, each sensing circuit being in a respective zone to be protected; and logic circuit means coupling said sensing circuits to said latch circuit means.

22. An alarm system according to claim 21, including a respective status lamp means in circuit with each respective sensing circuit for indicating the status thereof.

23. An alarm system according to claim 21, wherein said logic circuit means comprise OR circuit means.

24. An electronic intrusion alarm system comprising:

at least one intrusion sensing circuit including first loop means with at least one normally-open contact switch and second loop means with at least one normally-closed contact switch, said sensing circuit including control signal circuit means responsive to output from said loops for producing a control signal whenever any of said contact switches is placed in its opposite condition;

latch circuit means responsive to the control signal output of said control signal circuit means for producing an enabling signal;

alarm signal producing means responsive to the enabling signal from said latch circuit means for producing an alarm signal; and a reset and arming circuit comprising a two state counter circuit, said counter circuit being controlled by a push-button switch buffered by a debounce circuit and connected to the clock input of said counter circuit.

25. An alarm system according to claim 24, including additionally manual reset and arming means for resetting said latch circuit means.

* * * * *